US009307618B2

(12) United States Patent
Tsang

(10) Patent No.: US 9,307,618 B2
(45) Date of Patent: Apr. 5, 2016

(54) MULTI-FUNCTION CONTROLLABLE LUMINOUS DECORATION

(71) Applicant: KINGTRONICS GROUP (XIAMEN) CO., LTD., Xiamen (CN)

(72) Inventor: William Wei Tsang, Hong Kong (CN)

(73) Assignee: KINGTRONICS GROUP (XIAMEN) CO., LTD., Xiamen, Fujian (CN)

( * ) Notice: Subject to any disclaimer, the term of this patent is extended or adjusted under 35 U.S.C. 154(b) by 0 days.

(21) Appl. No.: 14/692,754

(22) Filed: Apr. 22, 2015

(65) Prior Publication Data

US 2015/0334810 A1 Nov. 19, 2015

(30) Foreign Application Priority Data

May 15, 2014 (CN) ..... 2014 1 0205326

(51) Int. Cl.
*H05B 37/02* (2006.01)
*H05B 33/08* (2006.01)

(52) U.S. Cl.
CPC ..... *H05B 37/0254* (2013.01); *H05B 33/0854* (2013.01); *H05B 33/0896* (2013.01)

(58) Field of Classification Search
CPC ..... H05B 33/0863; H05B 33/0842; H05B 33/0869; H05B 37/029; H05B 33/0803; H05B 37/0272; H05B 33/0815; H05B 37/02; H05B 37/0254; H05B 37/0227; F21W 2121/00; F21W 2121/04; F21V 23/0442
See application file for complete search history.

(56) References Cited

U.S. PATENT DOCUMENTS

| | | | | |
|---|---|---|---|---|
| 6,439,723 | B1 * | 8/2002 | Tano | G03B 21/00 353/15 |
| 7,717,584 | B1 * | 5/2010 | Tuan | G09F 13/22 362/103 |
| 2005/0272343 | A1 * | 12/2005 | Lee | B44C 5/005 446/71 |
| 2010/0226617 | A1 * | 9/2010 | Piccionelli | A47G 33/08 345/2.1 |

* cited by examiner

*Primary Examiner* — Jany Richardson
(74) *Attorney, Agent, or Firm* — Leong C. Lei

(57) ABSTRACT

A multi-function controllable luminous decoration includes a casing and an inductive light-emitting device disposed in the casing. The inductive light-emitting device includes a detection switch, a control unit, a light-emitting unit, a TF (Trans-Flash) card, a main control chip, a data line port, a battery, and a charging management chip. The present invention is able to vibrate and emit light, and has the functions of showing the characters and pictures stored in the TF card, storage, charging management, enhancing culture information and increasing ornament, interesting and practicability to satisfy the demands of more consumers.

10 Claims, 3 Drawing Sheets

MULTI-FUNCTION CONTROLLABLE LUMINOUS DECORATION

BACKGROUND OF THE INVENTION (a) Technical Field of the Invention

The present invention relates to a decoration, and more particularly to a multi-function controllable luminous decoration.

(b) Description of the Prior Art

These days, most of the decorations, such as crystals, diamonds and pendants, don't have a light-emitting function. In daylight, these decorations are very bright, but in a dark environment, its decorative effect is not obvious. Some decorations have a light-emitting function in a monotonous emitting way. The decorative effect is not good. In addition, pendants generally function as decorations with a single function. Development of electronic technology increases diversity and interesting of the decorations.

Chinese Patent Publication No. CN 201769599 U published Mar. 23, 2011 discloses a decoration. The decoration comprises a light-emitting device to emit light according to the detected shaking. The light-emitting device comprises a shaking sensor for detecting shaking and a direction sensor for detecting the setting direction of the light-emitting device. The light-emitting device emits light only when the shaking sensor detects shaking and the direction sensor detects a predetermined setting direction of the light-emitting device. The light emission of the decoration is limited to the predetermined setting direction, without considering other functions.

Chinese Patent Publication No. CN 102987703 A published Mar. 27, 2013 discloses a luminous decoration. The luminous decoration includes a decorative body. The decorative body has a light-emitting member. The light-emitting member is connected to a PCB board, and a battery disposed in the decorative body is to supply power. A vibration switch is provided on the PCB board to control the light emission of the light-emitting member. The rear end of the decorative body is provided with a rear cover for installation and replacement of the battery. The rear cover is coupled by means of screw connection. The rear cover connects the electrical circuit between the battery and the PCB board. The rear end of the decoration is provided with the rear cover, which influences the integrity of the decoration.

Chinese Patent Publication No. CN 201109338Y published Sep. 3, 2008 discloses a decoration coupled to an article. The decoration comprises a coupling member for the decoration to be coupled to the article, a shaped decorative member fixed to one end of the coupling member, and a light-emitting device disposed inside the shaped decorative member. The light-emitting device includes a light-emitting member to emit light by means of vibration. At least one battery is provided for supplying power to the light emitting member. The light-emitting device is disposed inside the shaped decorative member. The shaped decorative member is pervious to light. The decoration further comprises many mechanical structures, such as a coupling member, a fixing portion, a block portion, a connecting portion, and so on, which influences the integrity of the device and doesn't consider other functions except the light-emitting function by means of vibration.

Chinese Patent Publication No. CN 2450937 Y published Oct. 3, 2001, discloses a flashing artificial decoration. The decoration comprises a casing and a movement wrapped and fixed in the casing. The movement comprises a button battery installed on a circuit board, a sensitive spring vibration switch, and light-emitting diodes connected by wires. The artificial decoration only provides a light-emitting function by means of vibration.

Accordingly, the inventor of the present invention has devoted himself based on his many years of practical experiences to solve these problems.

SUMMARY OF THE INVENTION

The primary object of the present invention is to provide a multi-function controllable luminous decoration which is able to vibrate and emit light and is simile based on a mechanical structure.

In order to achieve the aforesaid object, the multi-function controllable luminous decoration of the present invention comprises a casing and an inductive light-emitting device disposed in the casing. The inductive light-emitting device comprises a detection switch, a control unit, a light-emitting unit, a TF (Trans-Flash) card, a main control chip, a data line port, a battery, and a charging management chip.

The detection switch is electrically connected with the control unit. The control unit is electrically connected with the light-emitting unit. The detection switch is adapted to induct a state signal of vibration or shaking and send the state signal to the control unit. The control unit controls emission of the light-emitting unit according to the state signal.

The TF card is electrically connected with the main control chip. The main control chip is electrically connected with the data line port. When the data line port is externally connected to a computer, the TF card and the main control chip are identified as a USB flash drive for data storage;

One end of the charging management chip is electrically connected with the battery, and another end of the charging management chip is electrically connected with the data line port. When the data line port is connected with an external power source, the charging management chip is adapted to control charging of the battery.

The battery is electrically connected with the control unit for supplying power to the light-emitting unit connected with the control unit;

The control unit is electrically connected with the data line port for supplying the power to the light-emitting unit connected with the control unit through the external power source.

Preferably, the data line port is a USB flash drive.

Preferably, the light-emitting unit is one of an LED (light emitting diode) light and an OLED (organic light emitting diode) display.

Preferably, the control unit is one of a single chip microcontroller, a DSP (digital signal processor), and a microprocessor.

Preferably, the detection switch is one of a vibration switch, a sensor, and a Hall sensor.

Preferably, the casing is provided with a metallic hook, and the metallic hook is provided with a hanging rope.

Preferably, the casing is etched with patterns and/or characters, and the light-emitting unit emits light through the patterns and/or characters.

Preferably, an inner surface of the casing is provided with a light-reflection layer and a light-pervious layer.

Preferably, the light-pervious layer is provided with a texture.

Preferably, the casing is composed of a bottom casing, a middle casing, and an upper casing. The bottom casing is electroplated with silver to form the light-reflection layer. An outer surface of the upper casing is polished to be smooth and shiny. An outer surface of the upper casing is formed with a coarse texture. The middle casing is etched with the patterns and/or characters by laser.

The present invention has the following advantages except functioning as a common decoration.

1. Achieving vibration or shaking function: The detection switch is adapted to induct a state signal of vibration or shaking and send the state signal to the control unit. The control unit controls the emission of the light-emitting unit according to the state signal and controls the light-emitting unit to get into a predetermined mode.

2. Achieving storage function: The main control chip is electrically connected with the data line port. When the data line port is electrically connected with a computer, the TF card and the main control chip are identified as a USB flash drive for data storage. In the USB flash drive, the TF card can be provided with built-in information which is not removable and rewritable.

3. Charging management function: One end of the charging management chip is electrically connected with the battery, and another end of the charging management chip is electrically connected with the data line port. When the data line port is connected with an external power source, the charging management chip is adapted to control charging of the battery, ensuring that the battery won't be overcharged. The battery of the present invention is a rechargeable battery.

4. Multiple elections for power supply. The battery can supply power to the light-emitting unit connected with the control unit directly, alternatively, an external power source can supply power to the light-emitting unit connected with the control unit.

The aforesaid multiple functions can be achieved by an integrated circuit of the inductive light-emitting device inside the casing. The aforesaid multiple functions enhance ornament, interesting and practicability of the decoration to satisfy the demands of more consumers.

The casing of the present invention can be one-piece or composed of several parts. No excessive mechanical structure is required, increasing the whole ornament of the decoration.

DETAILED DESCRIPTION OF THE PREFERRED EMBODIMENTS

Embodiments of the present invention will now be described, by way of example only, with reference to the accompanying drawings.

Figure 1:
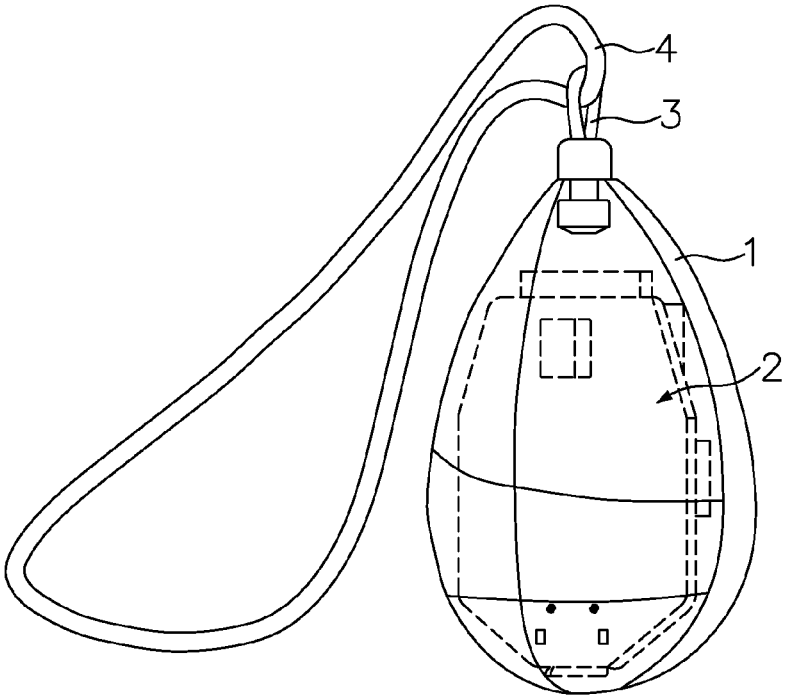
FIG. 1 is a perspective view of the present invention.
Figure 2:
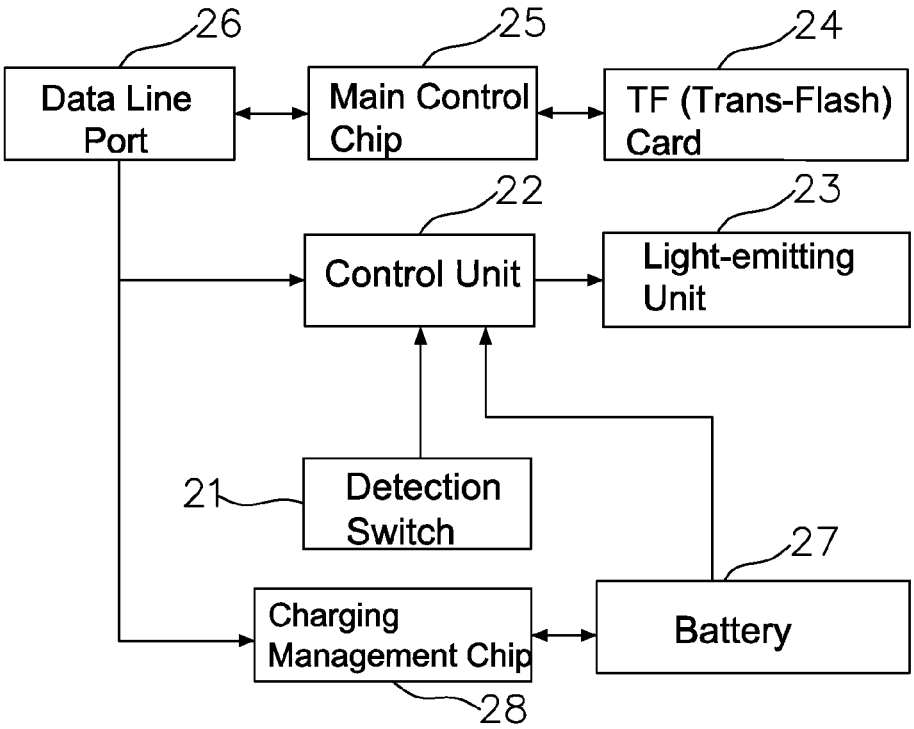
FIG. 2 is a block diagram showing the inductive light-emitting device of the present invention.

As shown in FIG. 1 and FIG. 2, the present invention discloses a multi-function controllable luminous decoration. The multi-function controllable luminous decoration comprises a casing 1 and an inductive light-emitting device 2 disposed in the casing 1. The inductive light-emitting device 2 comprises a detection switch 21, a control unit 22, a light-emitting unit 23, a TF (Trans-Flash) card 24, a main control chip 25, a data line port 26, a battery 27, and a charging management chip 28.

The detection switch 21 is electrically connected with the control unit 22. The control unit 22 is electrically connected with the light-emitting unit 23. The detection switch 21 is adapted to induct a state signal of vibration or shaking and send the state signal to the control unit 22. The control unit 22 controls the emission of the light-emitting unit 23 according to the state signal.

The TF card 24 is electrically connected with the main control chip 25. The main control chip 25 is electrically connected with the data line port 26. When the data line port 26 is externally connected to a computer, the TF card 24 and the main control chip 25 are identified as a USB flash drive for data storage.

One end of the charging management chip 28 is electrically connected with the battery 27, and another end of the charging management chip 28 is electrically connected with the data line port 26. When the data line port 26 is connected with an external power source, the charging management chip 28 is adapted to control charging of the battery 27.

The battery 27 is electrically connected with the control unit 22 for supplying power to the light-emitting unit 23 connected with the control unit 22.

The control unit 22 is electrically connected with the data line port 26 for supplying power to the light-emitting unit 23 connected with the control unit 22 through the external power source.

Wherein, the detection switch 21 can be a vibration switch, a sensor, or a Hall sensor. When the detection switch 21 adopts the vibration switch or the sensor, it can detect or sense the vibration or shaking of the decoration. When it detects or senses the predetermined vibration or shaking, it will send a signal to the control unit 22. The control unit 22 controls the light-emitting modes of the light-emitting unit 23 according to the signal, and the different light-emitting modes can be switched. When the detection switch 21 adopts the Hall sensor, namely, it is installed with a magnetic induction Hall sensor, the Hall sensor is able to activate the emission of the decoration in a non-contact way (such as a fixed magnetic field or a rotating magnetic field).

The light-emitting unit 23 can be an LED (light emitting diode) light, an OLED (organic light emitting diode) flexible display, or the like. The LED light can be composed of one LED or a plurality of LEDs. The control unit 22 is further electrically connected with the battery 27 for detecting the quantity of electricity of the battery 27 and indicating the state through the emission of the light-emitting unit 23. The control unit 22 also detects the connecting state of the data line port. When an external power source is plugged, the control unit 22 can control the light-emitting unit 23 to get into the predetermined flash mode. The data line port 26 can be a USB port, an R232 port, and so on. The control unit 22 can be a single chip microcontroller, a DSP (digital signal processor), or a microprocessor.

Figure 3:
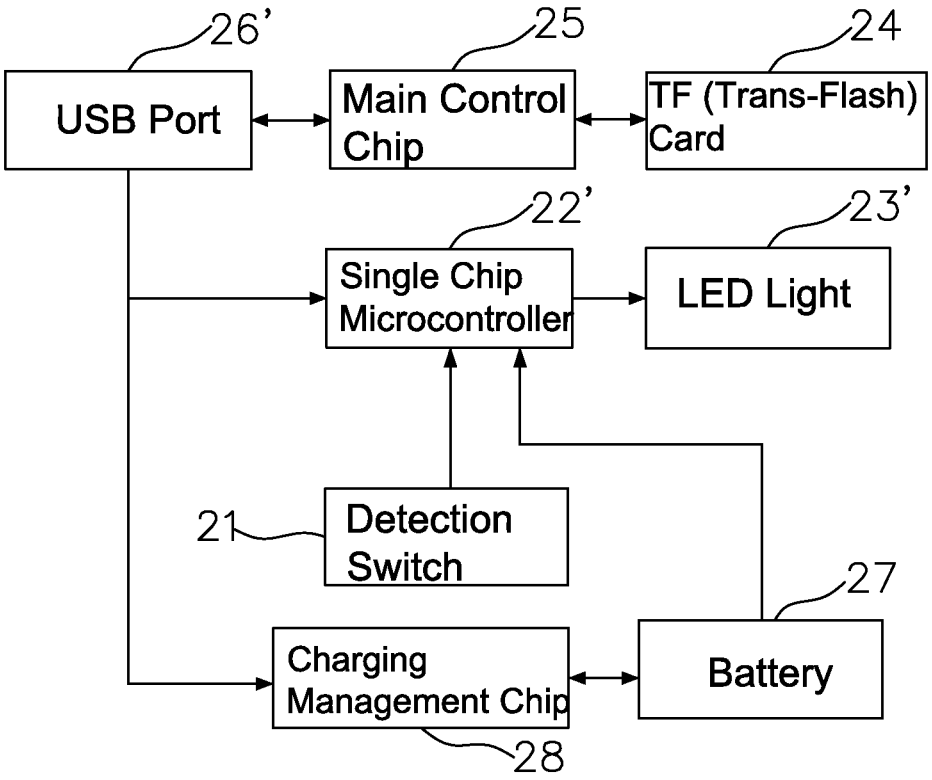
FIG. 3 is a side view of the present invention.

For example, the data line port 26 is a USB port 26', the control unit 22 is a single chip microcontroller 22', and the light-emitting unit 23 is an LED light 23'. As shown in FIG. 3, the main control chip 25 is electrically connected with the USB port 26' and the TF card 24. When the USB port 26' is electrically connected with a computer, it can be identified as a USB flash drive to carry out reading and writing operations. The USB flash drive can be provided with built-in information which is not removable and rewritable, namely, the built-in TF card can be provided with information which is not removable and rewritable.

The battery 27 is a rechargeable battery. The power source is connected from the USB port. The charging management chip 28 controls charging of the battery 27, preventing the battery 27 from being overcharged. The battery 27 can be further provided with a charging protection circuit (not shown in the drawings) to prevent the battery 27 from a short circuit or discharging too much.

The USB port can close or activate the battery to supply electricity, preventing the electricity of the battery from running out during transportation.

In the aforesaid, the main control chip 25 can adopt a GL823 chip. The charging management chip 28 can adopt a HM4054 chip. The single chip microcontroller can adopt PIC12F1840T.

Figure 4:
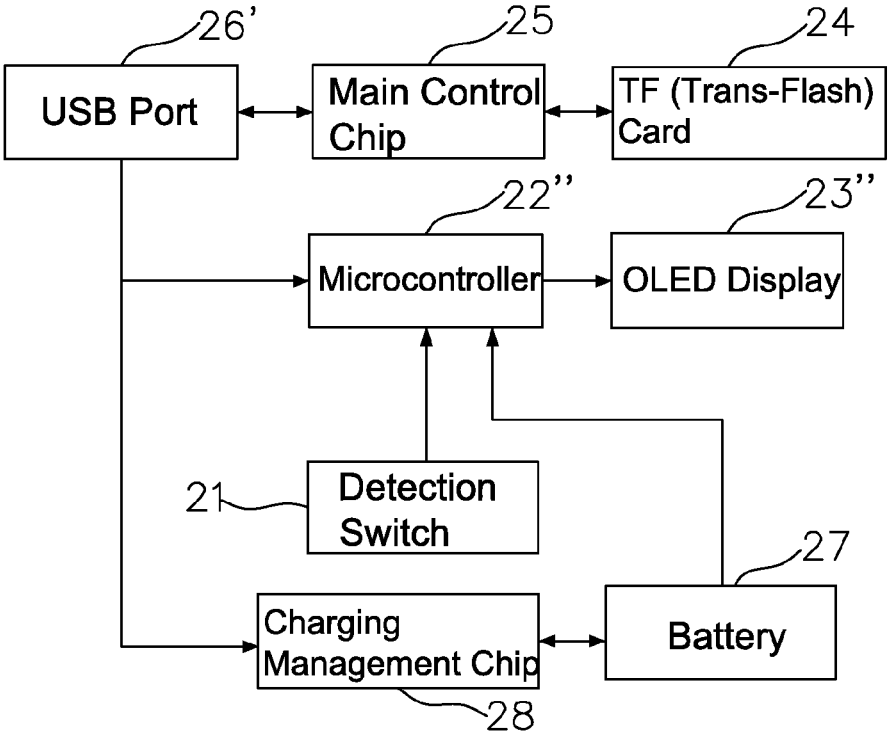
FIG. 4 is a block diagram showing the inductive light-emitting device according to an embodiment of the present invention.

As an example, the data line port 26' is a USB flash drive, the control unit 22 is a microcontroller 22", and the light-emitting unit 23 is an OLED display 23". As shown in FIG. 4, the main control chip 25 is electrically connected with the USB port 26' and the TF card 24. When the USB port 26' is electrically connected with a computer, it can be identified as a USB flash drive to carry out reading and writing operations. The USB flash drive can be provided with built-in information which is not removable and rewritable, namely, the built-in TF card can be provided with information which is not removable and rewritable. The TF card can be stored with the characters and pictures. The characters and pictures can be displayed by the OLED display. That is, the TF card stores the characters and pictures as the data to be transmitted to the microcontroller 22" and displayed by the OLED display, increasing the information of the decoration and enhancing the culture information of the decoration.

In the aforesaid, the microprocessor can adopt a 32-bit microprocessor LPC1102.

For the decoration to be carried on the user conveniently, the casing 1 is provided with a metallic hook 3 and the metallic hook 3 is provided with a hanging rope 4, as shown in FIG. 1.

For a specific emitting way, the casing 1 is etched with patterns and/or characters. Through the patterns and/or characters, the light-emitting unit 23 emits light to form a specific decoration. It is noted that the patterns and characters include the signs of twelve constellations, the characters of Sanskrit, names, and patterns. In order to form a distinguishing characteristic, the present invention can be applied to bracelets, pendants, and table decorations.

The casing 1 can be made of PC (polycarbonate) or ABS (Acrylonitrile Butadiene StyreneAcrylonitrile Butadiene Styrene) material. The inner surface of the casing is further provided with a light-reflection layer and a light-pervious layer. The light-reflection layer can be instead of light-proof layer.

For the light-emitting unit 23 to emit light through the patterns and/or characters, the way can be that the casing 1 made of PC or ABS material is electroplated with silver to form the light-reflection layer. The light-pervious layer is etched with the patterns and/or characters by laser. In order to achieve a flash effect, the light-pervious layer is provided with a texture which can be a coarse texture, a diamond texture, or an etching texture, or a combination thereof.

Figure 5:
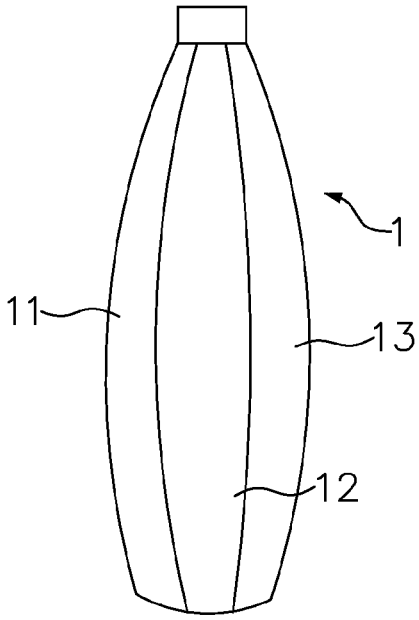
FIG. 5 is a block diagram showing the inductive light-emitting device according to another embodiment of the present invention.

As shown in FIG. 5, the casing 1 is composed of a bottom casing 11, a middle casing 12, and an upper casing 13. The bottom casing 11 is electroplated with silver to form the light-reflection layer. The outer surface of the upper casing 13 is polished to be smooth and shiny, and the outer surface of the upper casing 13 is formed with a coarse texture. The middle casing 12 is etched with the light-previous patterns and/or characters by laser. Before etching the patterns and/or characters by laser, it can be sprayed with oil to form a lightproof layer, such that the patterns and/or characters are able to emit light in the middle casing 12 separately.

Although particular embodiments of the present invention have been described in detail for purposes of illustration, various modifications and enhancements may be made without departing from the spirit and scope of the present invention. The present invention can be applied to bracelets, pendants, table decorations, and the like. The patterns and characters are not limited to the signs of twelve constellations, the characters of Sanskrit, names, and patterns. Accordingly, the present invention is not to be limited except as by the appended claims.

I claim:

1. A multi-function controllable luminous decoration, comprising a casing and an inductive light-emitting device disposed in the casing, the inductive light-emitting device comprising a detection switch, a control unit, a light-emitting unit, a TF (Trans-Flash) card, a main control chip, a data line port, a battery, and a charging management chip;

the detection switch being electrically connected with the control unit, the control unit being electrically connected with the light-emitting unit, the detection switch being adapted to induct a state signal of vibration or shaking and send the state signal to the control unit, the control unit controlling emission of the light-emitting unit according to the state signal;

the TF card being electrically connected with the main control chip, the main control chip being electrically connected with the data line port, wherein when the data line port is externally connected to a computer, the TF card and the main control chip are identified as a USB flash drive for data storage;

one end of the charging management chip being electrically connected with the battery, another end of the charging management chip being electrically connected with the data line port, wherein when the data line port is connected with an external power source, the charging management chip is adapted to control charging of the battery;

the battery being electrically connected with the control unit for supplying power to the light-emitting unit connected with the control unit;

the control unit being electrically connected with the data line port for supplying the power to the light-emitting unit connected with the control unit through the external power source.

2. The multi-function controllable luminous decoration as claimed in claim 1, wherein the data line port is a USB flash drive.

3. The multi-function controllable luminous decoration as claimed in claim 1, wherein the light-emitting unit is one of an LED (light emitting diode) light and an OLED (organic light emitting diode) display.

4. The multi-function controllable luminous decoration as claimed in claim 1, wherein the control unit is one of a single chip microcontroller, a DSP (digital signal processor), and a microprocessor.

5. The multi-function controllable luminous decoration as claimed in claim 1, wherein the detection switch is one of a vibration switch, a sensor, and a Hall sensor.

6. The multi-function controllable luminous decoration as claimed in claim 1, wherein the casing is provided with a metallic hook, and the metallic hook is provided with a hanging rope.

7. The multi-function controllable luminous decoration as claimed in claim 1, wherein the casing is etched with patterns and/or characters, and the light-emitting unit emits light through the patterns and/or characters.

8. The multi-function controllable luminous decoration as claimed in claim 7, wherein an inner surface of the casing is provided with a light-reflection layer and a light-pervious layer.

9. The multi-function controllable luminous decoration as claimed in claim 8, wherein the light-pervious layer is provided with a texture.

10. The multi-function controllable luminous decoration as claimed in claim 9, wherein the casing is composed of a bottom casing, a middle casing, and an upper casing, the bottom casing is electroplated with silver to form the light-reflection layer, an outer surface of the upper casing is polished to be smooth and shiny, an outer surface of the upper casing is formed with a coarse texture, and the middle casing is etched with the patterns and/or characters by laser.

* * * * *